US005788237A

United States Patent [19]

Fults et al.

[11] Patent Number: 5,788,237

[45] Date of Patent: Aug. 4, 1998

[54] LOTTERY-TYPE GAMING METHOD HAVING MULTIPLE PLAYING LEVELS

[75] Inventors: J. Wesley Fults, Edmonds; David J. Cherry, Mukilteo, both of Wash.

[73] Assignee: Bonanza Press, Inc., Woodinville, Wash.

[21] Appl. No.: 653,304

[22] Filed: May 24, 1996

[51] Int. Cl.[6] ..... A63F 3/06

[52] U.S. Cl. ..... 273/269; 273/139

[58] Field of Search ..... 273/139, 269, 273/237; 463/16, 17, 19

[56] References Cited

U.S. PATENT DOCUMENTS

| | | | |
|---|---|---|---|
| 3,703,727 | 11/1972 | Knowlton . | |
| 4,032,764 | 6/1977 | Savage . | |
| 4,121,830 | 10/1978 | Buckley . | |
| 4,200,935 | 4/1980 | Hoffmann et al. . | |
| 4,373,726 | 2/1983 | Churchill . | |
| 4,484,297 | 11/1984 | Maier et al. . | |
| 4,527,798 | 7/1985 | Siekierski . | |
| 4,573,681 | 3/1986 | Okada . | |
| 4,624,462 | 11/1986 | Itkis | 273/237 |
| 4,665,502 | 5/1987 | Kreisner . | |
| 4,692,863 | 9/1987 | Moosz . | |
| 4,713,787 | 12/1987 | Rapp . | |
| 4,740,016 | 4/1988 | Konecny et al. . | |
| 4,775,155 | 10/1988 | Lees . | |
| 4,943,090 | 7/1990 | Fienberg . | |
| 5,046,737 | 9/1991 | Fienberg . | |
| 5,332,218 | 7/1994 | Lucey . | |
| 5,356,144 | 10/1994 | Fitzpatrick et al. . | |
| 5,407,200 | 4/1995 | Zalabak . | |
| 5,411,260 | 5/1995 | Smith . | |
| 5,417,424 | 5/1995 | Snowden . | |
| 5,421,576 | 6/1995 | Yamazaki et al. . | |
| 5,560,608 | 10/1996 | Silverschotz | 273/139 X |
| 5,580,311 | 12/1996 | Haste, III | 463/17 |
| 5,645,167 | 7/1997 | Behm et al. | 273/269 |

*Primary Examiner*—William E. Stoll
*Attorney, Agent, or Firm*—Graybeal Jackson Haley LLP

[57] ABSTRACT

A gaming method comprises the selection of a plurality of playing card game symbols, with at least two game symbols for each playing card such that each playing card has the same number of game symbols. A plurality of sets of winning game symbols are randomly selected from the plurality of game symbols selected for the playing cards, with at least some sets of winning game symbols having a different number of game symbols than other sets of winning game symbols. Each set of winning game symbols is a different set of game symbols than all other sets of winning game symbols, and each set of winning game symbols is on only one playing card. The game symbols for all of the sets of winning game symbols for all of the winning playing cards are randomly organized to be listed on a master card such that all of the game symbols for any one set of winning game symbols on a particular playing card are not necessarily listed sequentially.

13 Claims, 16 Drawing Sheets

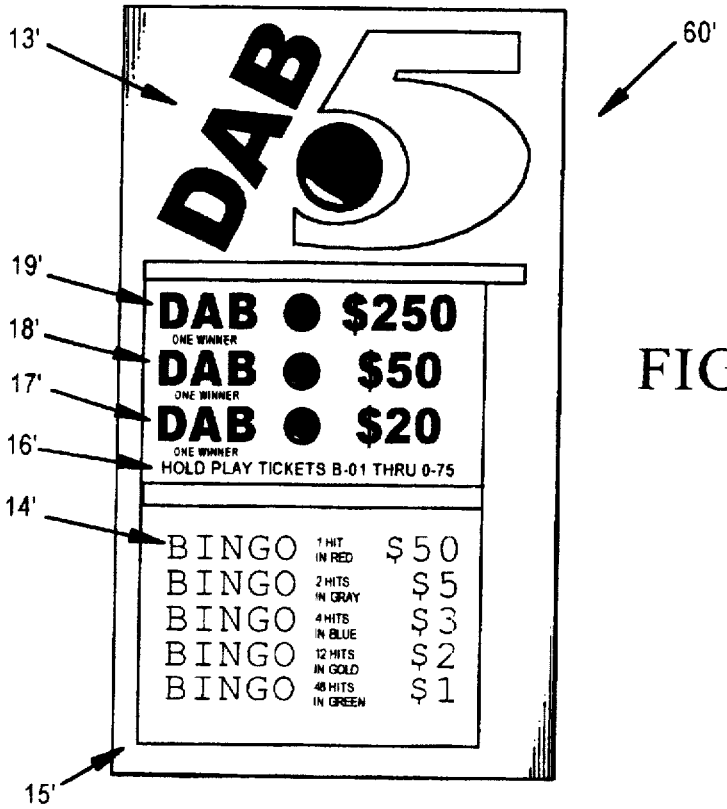
FIG.12
FIG.13
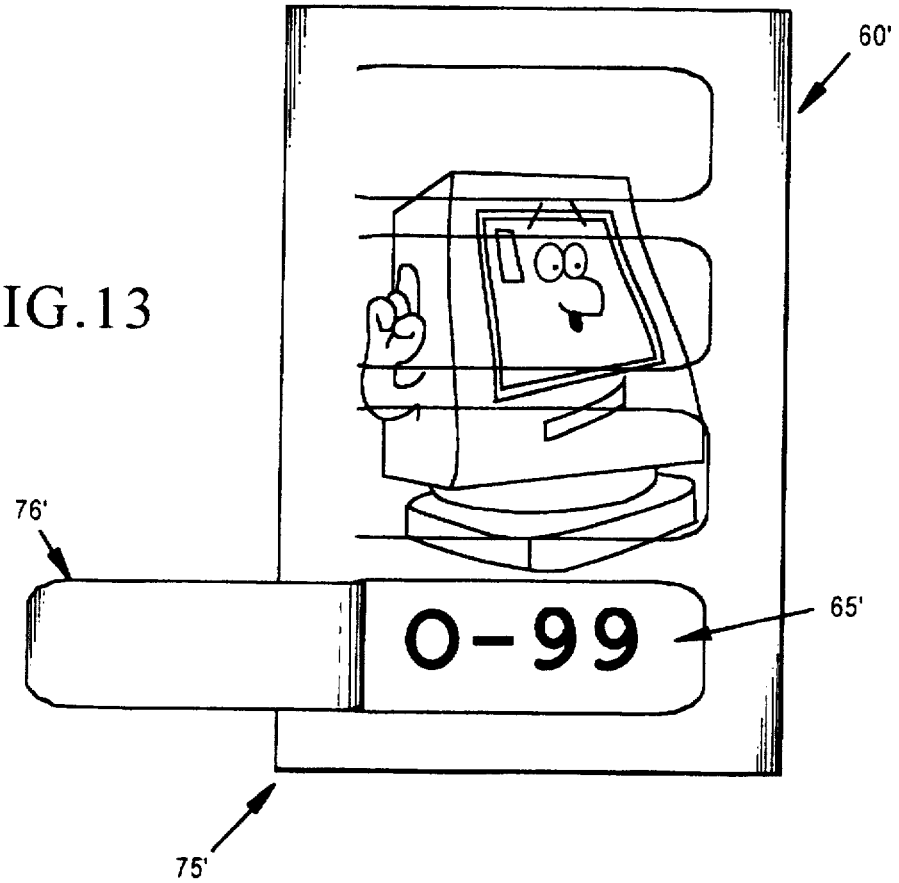

LOTTERY-TYPE GAMING METHOD HAVING MULTIPLE PLAYING LEVELS

BACKGROUND OF THE INVENTION

The present invention relates to gaming systems and, more particularly, to a lottery-type gaming system having more than one level of play.

Lottery-type games of chance have exhibited enduring popularity, since such games typically permit a player to make a relatively small "investment" with a chance of winning a significantly larger award. The entertainment which these types of games of chance provide can be enhanced by increasing the player involvement during prize determination.

SUMMARY OF THE INVENTION

A gaming method comprises the selection of a plurality of playing card game symbols, with at least two game symbols for each playing card such that each playing card has the same total number of game symbols. A plurality of sets of winning game symbols are randomly selected from the plurality of game symbols selected for the playing cards, with at least some sets of winning game symbols having a different number of game symbols than other sets of winning game symbols. Each set of winning game symbols is a different set of game symbols than all other sets of winning game symbols, and each set of winning game symbols is on only one playing card. The game symbols for all of the sets of winning game symbols for all of the winning playing cards are randomly organized to be listed a master card such that all of the game symbols for any one set of winning game symbols on a particular playing card are not necessarily listed sequentially.

In one preferred embodiment, four game symbols are selected for each playing card, with three sets of winning game symbols randomly selected and the number of winning game symbols in the three sets being two, three and four. A computer is preferably employed to randomly select sets of winning game symbols from the plurality of selected playing card game symbols and to randomly organize all of the game symbols for all of the sets of winning game symbols to be listed on a master card.

A plurality of playing cards are then printed based on this method of selection for the game symbols and sets of winning game symbols. The game symbols printed on the playing cards are preferably located under removable opaque windows.

A master card is printed on which all of the game symbols for all of the sets of winning game symbols selected by the method described above are randomly listed. This master card is preferably sealed prior to distribution of the playing cards and is subsequently unsealed to read the game symbols thereon after distribution of the playing cards.

Non-winning game symbols also can be randomly selected, preferably by computer, and randomly listed with the randomly listed game symbols for all of the sets of winning game symbols on the master card. Preferably, the number of sets of winning game symbols is equal to the number of game symbols on each playing card.

In one alternative preferred embodiment, five game symbols are selected for each playing card, with three levels of winning game combinations randomly selected; these being sets of three, four and five symbols having matches on the playing cards. Certain symbols on the master playing card, such as two of fourteen, are phantom symbols that enhance game play but do not determine winners.

The present game is well suited for fund raising activities. The inclusion of symbols on the master game card that gives chances for prizes that increase with the number of symbols matched serves to increase excitement in playing the present game symbol.

BRIEF DESCRIPTION OF THE DRAWINGS

These and other features of the present invention will be more fully appreciated when considered in light of the following specification and drawings in which:

FIGS. 9-1, 9-2, 9-3, and 9-4 are a series of flow charts depicting the computer logic employed to select the winning numbers printed on the master card.

FIG. 12 is a top plan view of the payout side of a playing ticket or card for the game of FIG. 10 showing, in particular, the indicia indicating a plurality of classes of winning game symbols;

FIG. 13 is a top plan view showing a portion of the pull tab side of a playing ticket or card of FIG. 12; also, the game alpha-numeric symbols displayed, and the computer animated image illustrated within the art print;

DETAILED DESCRIPTION OF THE PREFERRED EMBODIMENTS

Figure 1:
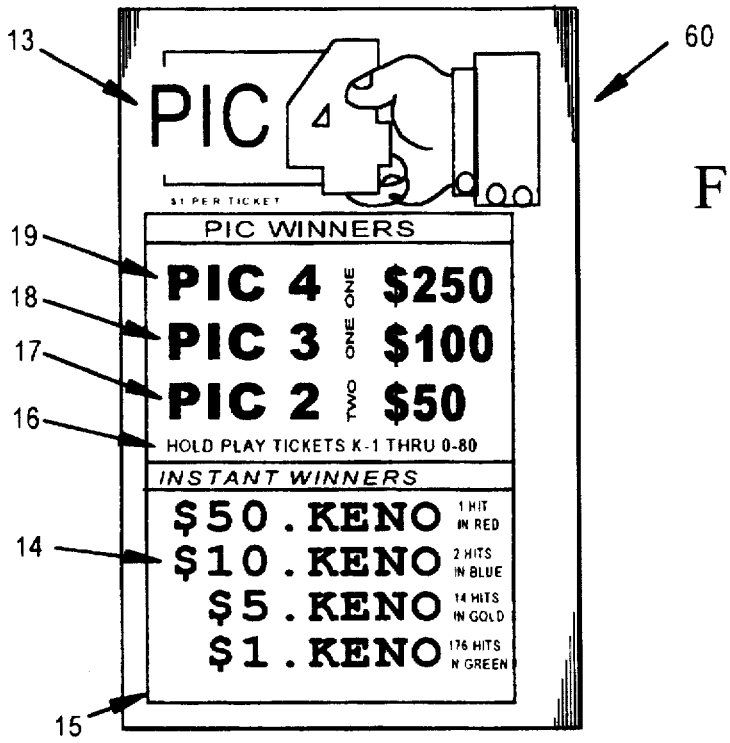
FIG. 1 of the drawings is a top plan view of the payout side of a playing card, showing, in particular, the indicia indicating a plurality of classes of winning game symbols.

The present gaming system is shown in FIGS. 1 through 9 as comprising a plurality of playing cards 60 and a master game card 10. Playing card 60 includes a payout side 13 as shown in FIG. 1, and an "open-here" or tab side 75 as shown in FIGS. 2 through 6. Tab side 75 of playing card 60 includes a plurality of game symbols such as symbol 65. Game symbols may comprise numeric designations "80" or below, as shown by elements 70, 71, 72, and 73 of FIG. 5, or comprise numeric designations "81" and above, as shown by elements 66, 67, 68, and 69 of FIG. 3. Alpha designations are the letters "K", "E", "N", "O" as shown by elements 70, 71, 72, and 73 of FIG. 5.

Referring to FIG. 1, pay out side 13 of playing card 60 includes indicia 15 indicating a plurality of classes of winning game symbols. Specifically, indicia 15 indicates whether an individual game symbol is within a class of the optional instant winning game symbols, or is alternatively within a class of game symbols eligible to be a winning game symbol identified by master game card 10 in the master card game.

Figure 2:
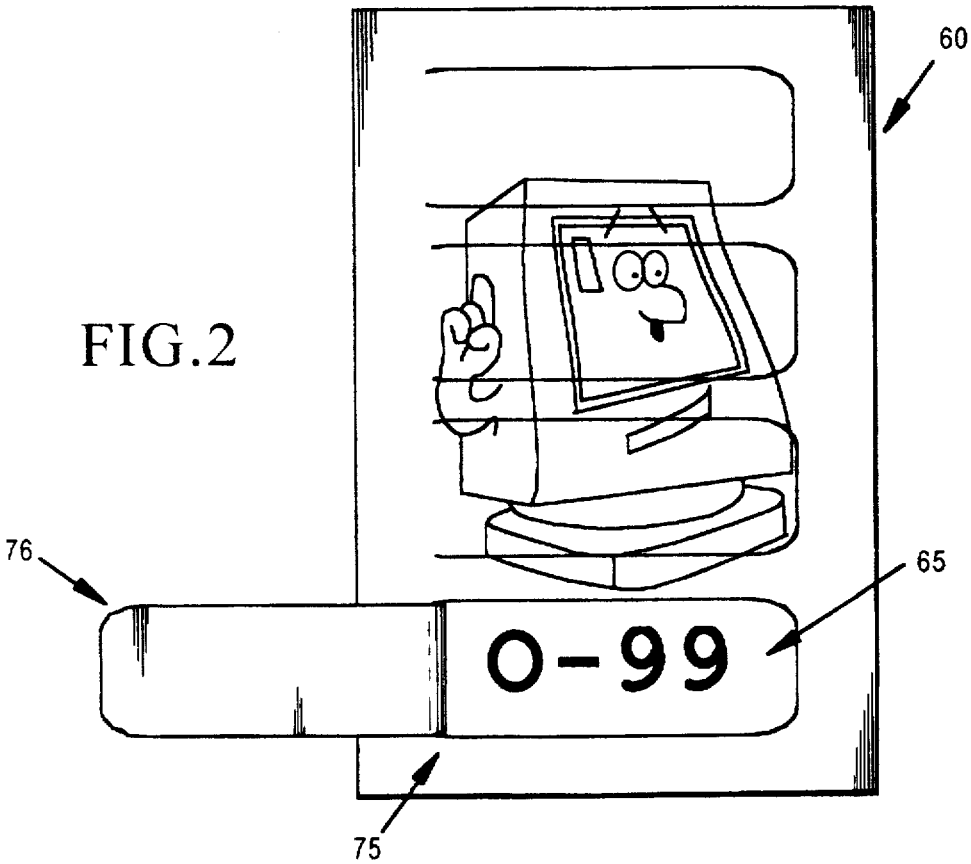
FIG. 2 of the drawings is a top plan view showing a portion of the tab side of a playing card with one of the alphanumeric windows opened to display one of the alphanumeric symbols.

Referring to FIG. 2, tab side 75 of playing card 60 further includes game symbol concealing device for initially concealing the game symbols 65 displayed upon the playing card 60. In the illustrated embodiment, the game symbol concealing device comprises a re-positionable flap-like member 76. When the playing cards 60 are initially distributed to players of the present gaming system, all the flap-like members 76 are in a closed position, covering the associated game symbols 65, as shown for the topmost three game symbols in FIG. 2. The players of the present gaming system, i.e., holders of playing cards 60, open each of the flap-like members 76 in order to reveal the game symbols 65 displayed beneath. In the illustrated embodiment, the playing cards 60 have a two-ply construction. A first ply bears the game symbols 65. A second overlying ply, attached to the first ply, includes substantially rectangular regions, frangible on three sides, which form flap-like members 76 and thus provide the game symbol concealing device.

Referring first to the optional instant winner game, in the illustrated embodiment indicia 15 indicates that game symbols of alphanumeric combinations designations including, for example, "K" "E" "N" "O" and numerics above "80" are instant winners. Prizes such as monetary entitlements for these instant winners are based on color of print, i.e. green, gold, blue or red, awarding holders of these cards to prizes of "$1", "$5", "$10" and "$50", respectively. Other prize combinations may be designated. Indicia 15 further indicates that game symbols which have alphanumeric designations with, for example, numbers "80" or less are game symbols which are eligible to be winning game symbols identified by master game card 10 that are potentially entitled to an award up to $250.00. Other prize designations could be used.

Figure 5:
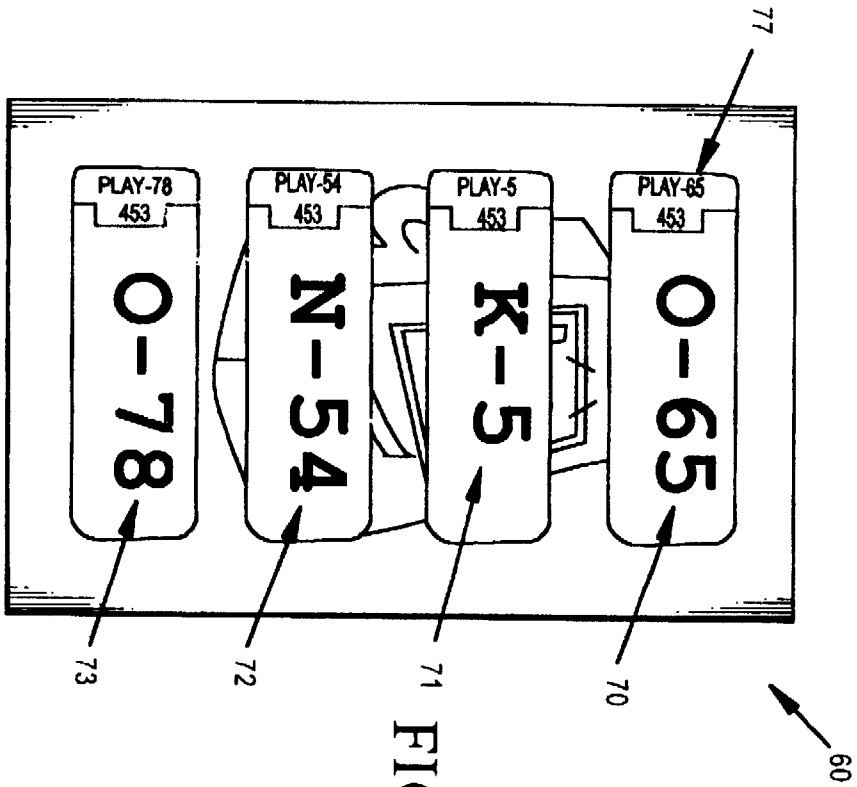
FIG. 5 of the drawings is a top plan view of a ticket which will have a chance to win when the master game card is revealed.
Figure 7:
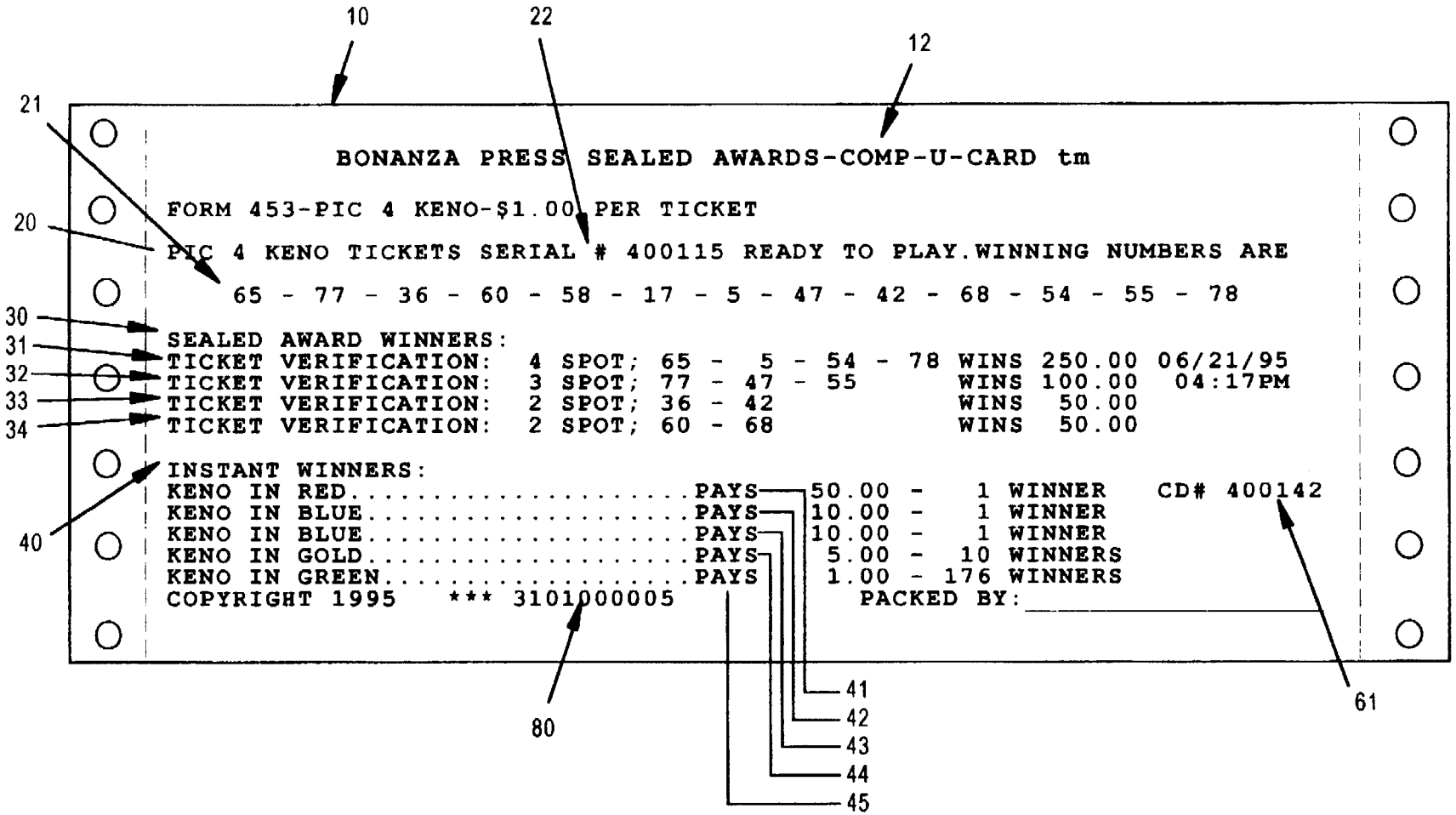
FIG. 7 of the drawings is a top plan view of the master game card, showing, in particular, the plurality of randomly organized numeral symbols which determines the plurality of winners.
Figure 8:
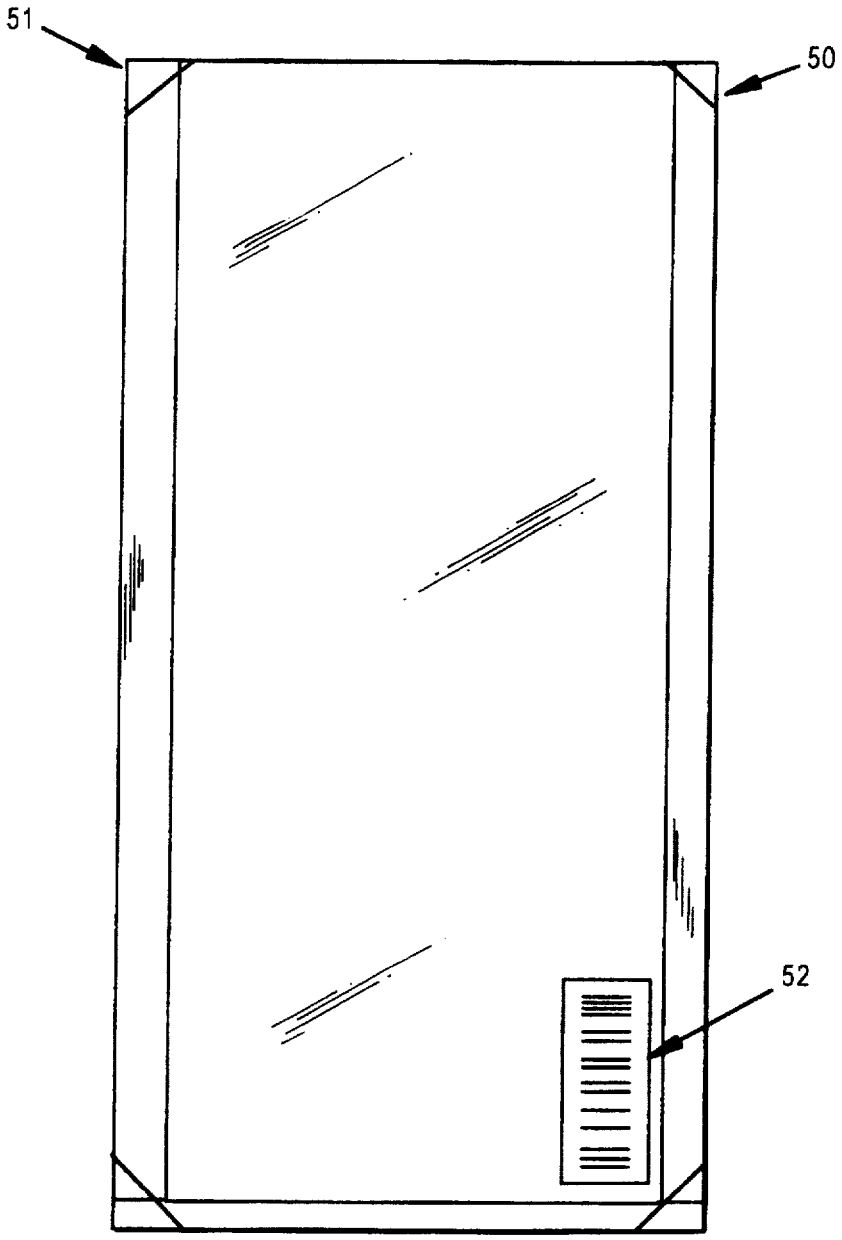
FIG. 8 of the drawings is a top plan view of the foiled sealed award envelope which conceals the master game card.
Figures 1, 9:
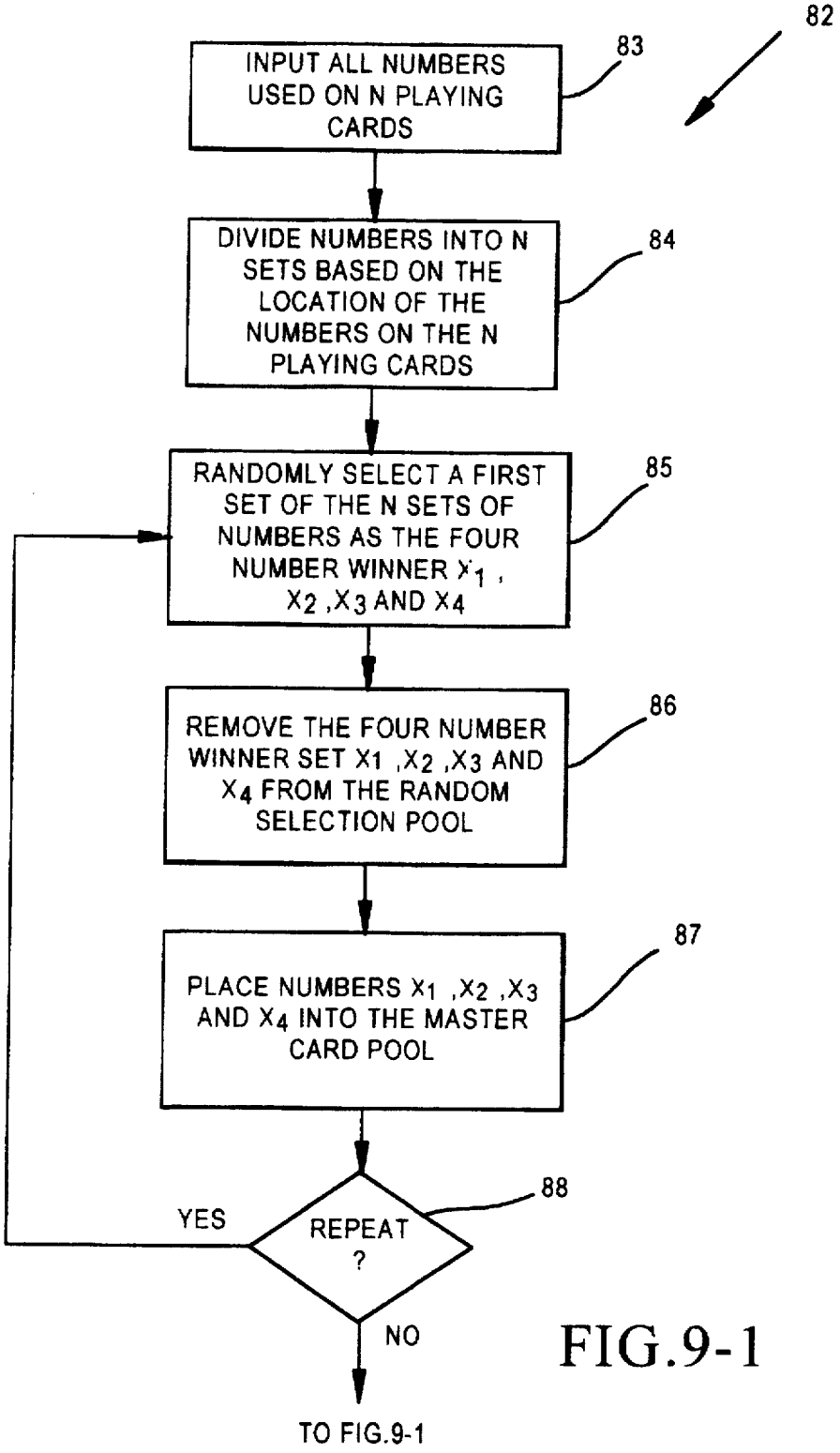
Figures 2, 9:
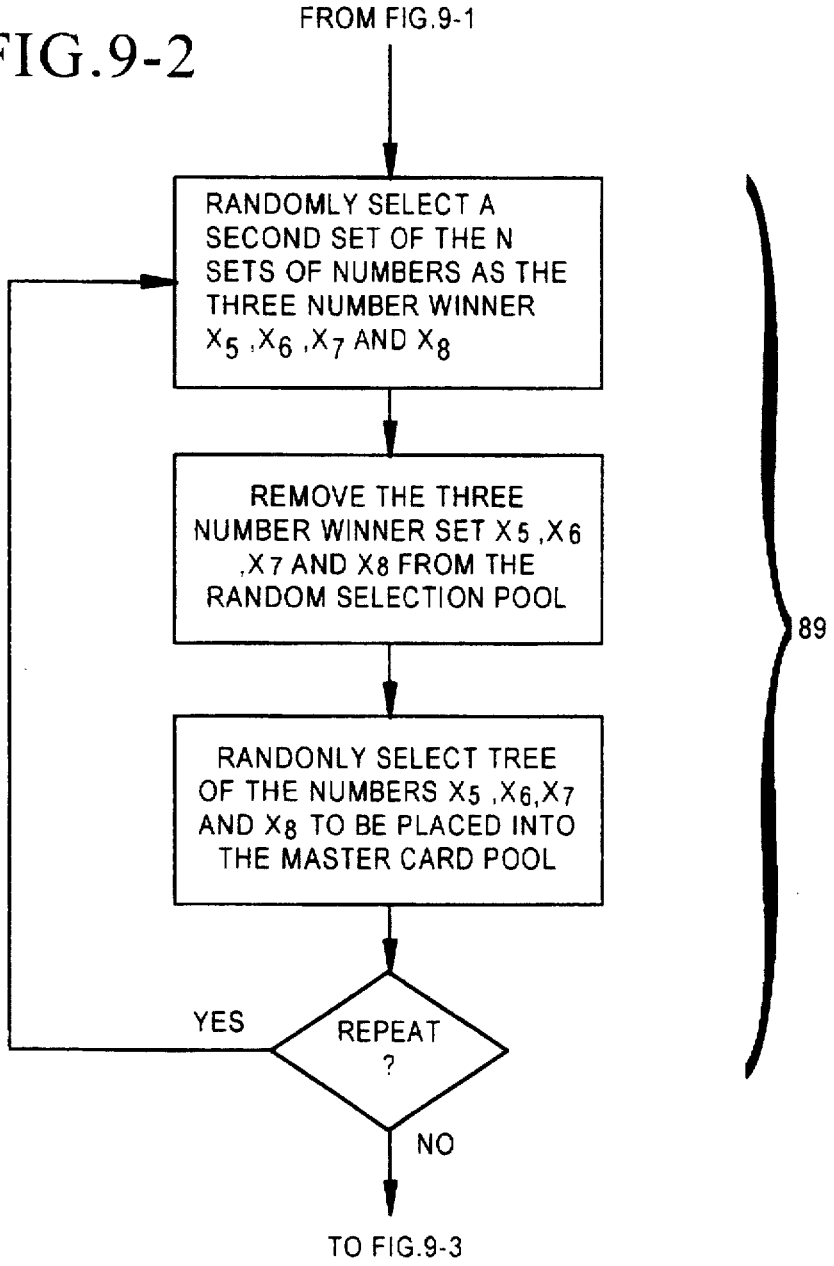
Figures 3, 9:
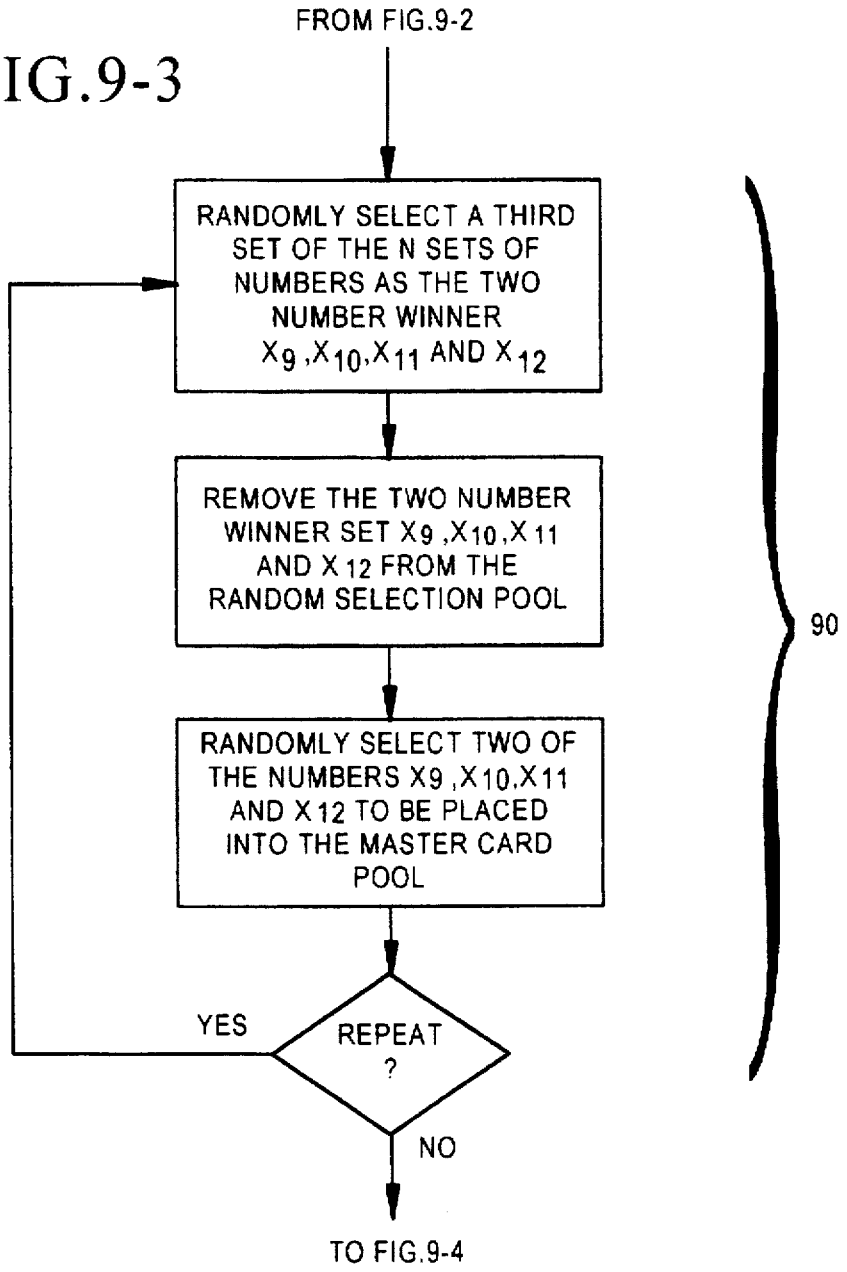
Figures 4, 9:
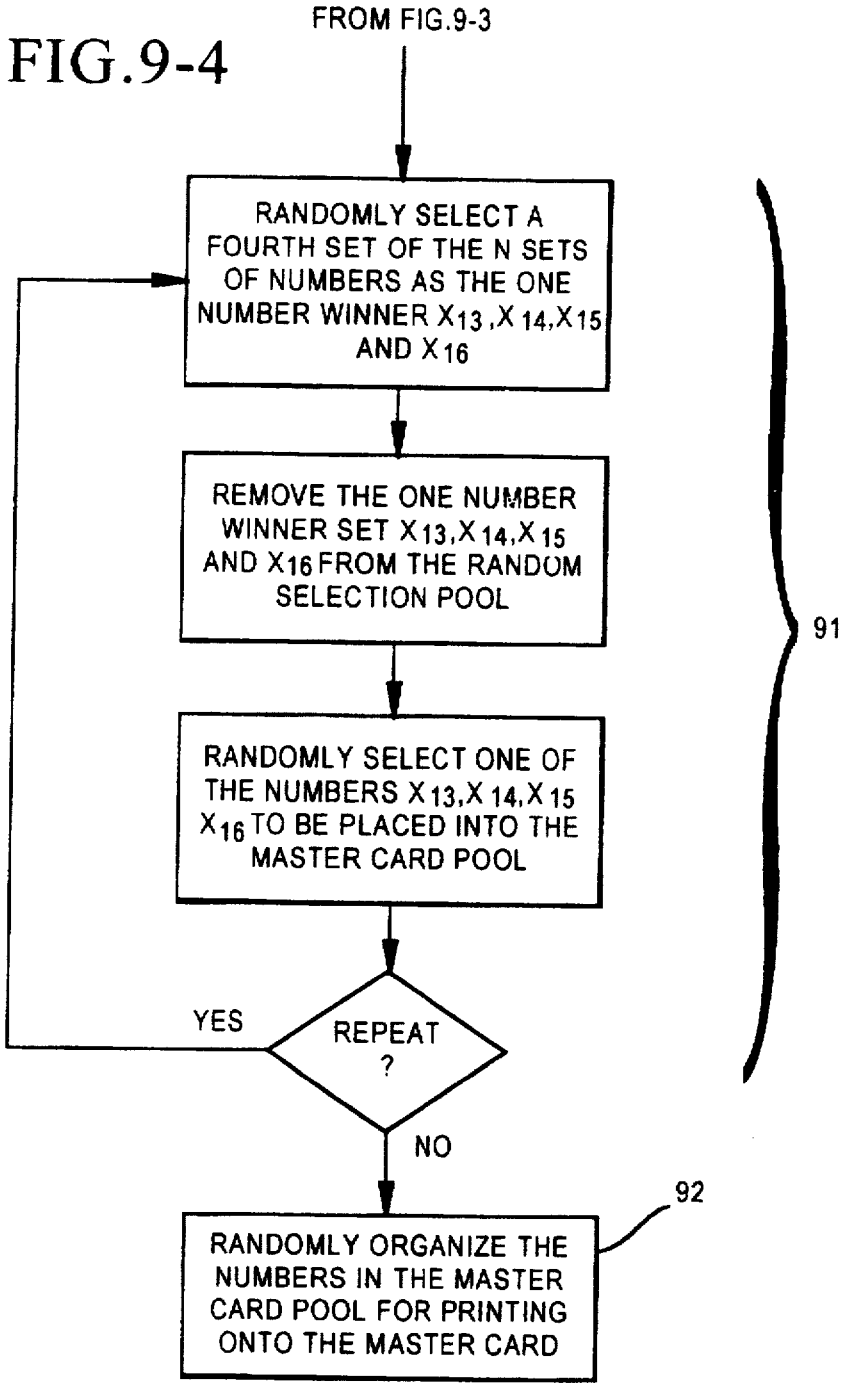

Now referring to the function of the master card, one sample master game card 10 is shown in FIG. 7 and includes thirteen numbers from "1" to "80". Each playing card 60 having symbol numbers of "80" or less is eligible to participate in the master card game play, as shown in FIG. 5. Each playing card 60 (FIG. 5) having numbers "80" or less will always contain four of the game symbols 65 eligible to win a prize determined by the master game card as shown by elements 70, 71, 72 and 73 of FIG. 5. These are playing cards 60 which are eligible to win during master game card 10 play. Each of the eligible numbers "1" through "80" is designated only once in the present gaming system. Adjacent each game symbol 65 eligible to win in conjunction with master game card 10 there is located a player indicia which informs the playing card holder of the "play number" of which he or she is in possession that may also be located on master card 10, i.e. eligible game symbol 70 has a player indicia of "play 65" adjacent game symbol "0–65", which informs the player to be attentive to whether number 65 appears on master card 10. The master game card 10 is enclosed in a sealed opaque lined foiled envelope 50 as shown in FIG. 8 that has a bar code label 52 affixed to it with the same serial number on it that is printed on all of the playing cards 60 in the present gaming system. The master game card 10 is kept sealed until all of the playing cards 60 have been purchased.

The master game card 10 has a purple highlighted section which, when removed from the envelope 50, is read. It announces at 20 the name of game, serial number 22 of playing cards 60 and the winning numbers at 21. A holder of a playing card 60 with eligible numbers "1" through "80" will match numbers revealed at 21 on the master game card 10 of FIG. 1. Prizes are determined by how many numbers the holder of the eligible playing card 60 matches of the thirteen numbers printed on the master game card 10. For example, there are two playing cards 60 that will match two of the numbers printed on the master game card 10. Each of the holders of these playing cards 60 will be awarded prizes as indicated on the indicia 15 on the pay out side 13 of the playing card 60. This is listed as "PIC 2" 17 of indicia 15 of FIG. 1. There is one playing card 60 that will match three of the numbers printed on the master game card 10. The holder of this playing card 60 will be awarded a prize as indicated on the indicia 15 on the pay out side 13 of the playing card 60. This is listed as "PIC 3" 18 of FIG. 1. There is one playing card 60 that will match all of the four numbers for this game embodiment printed on the master game card 10. The holder of this playing card 60 will be awarded a prize as indicated on the indicia 15 on the pay out side 13 of the playing card 60. This is listed as "PIC 4", 19 of FIG. 1. There are two playing cards 60 that will match only one number printed on the master game card 10. Each of the holders of these playing cards 60 will not be awarded a prize. These one number matching playing cards 60 are provided to enhance the entertainment value of the present gaming system. No holder of an eligible playing card 60 for matches of the master game card 10 is "eliminated" until the twelfth number printed is called. Then any holder of an eligible playing card 60 with no matched numbers would be eliminated.

Figure 6:
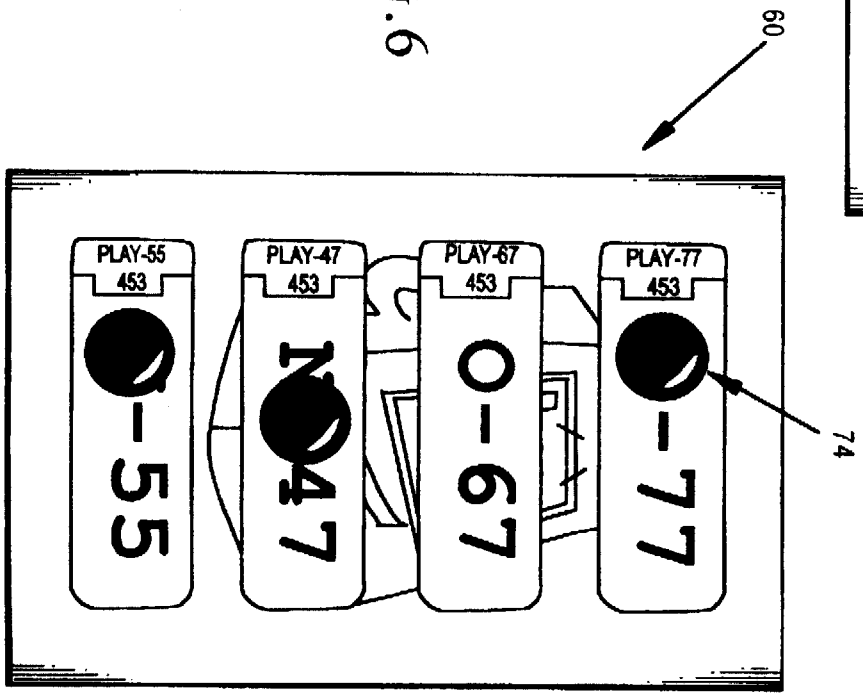
FIG. 6 of the drawings is a top plan view of a ticket which has been played during the event of revealing a master game card and which indicates a three-symbol winning set.

The holders of playing cards 60 which are eligible for play with master game card 10, can mask 74 those numbers that match the numbers printed on the master game card 10 by using a "Bingo Dauber" as shown in FIG. 6.

Figure 3:
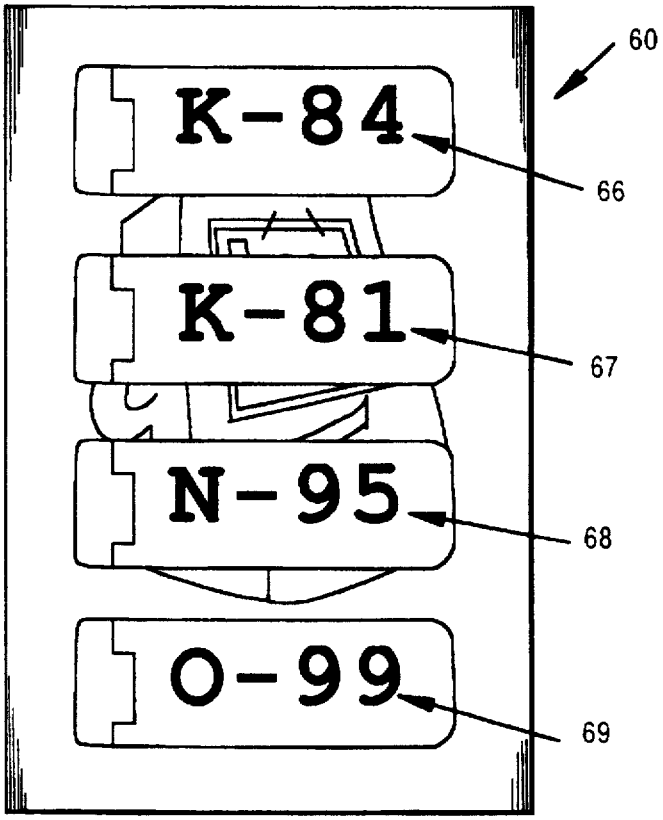
FIG. 3 of the drawings is a top plan view of an opened playing card which has no instant winning symbols and has no chance to win when the master game card is revealed.
Figure 4:
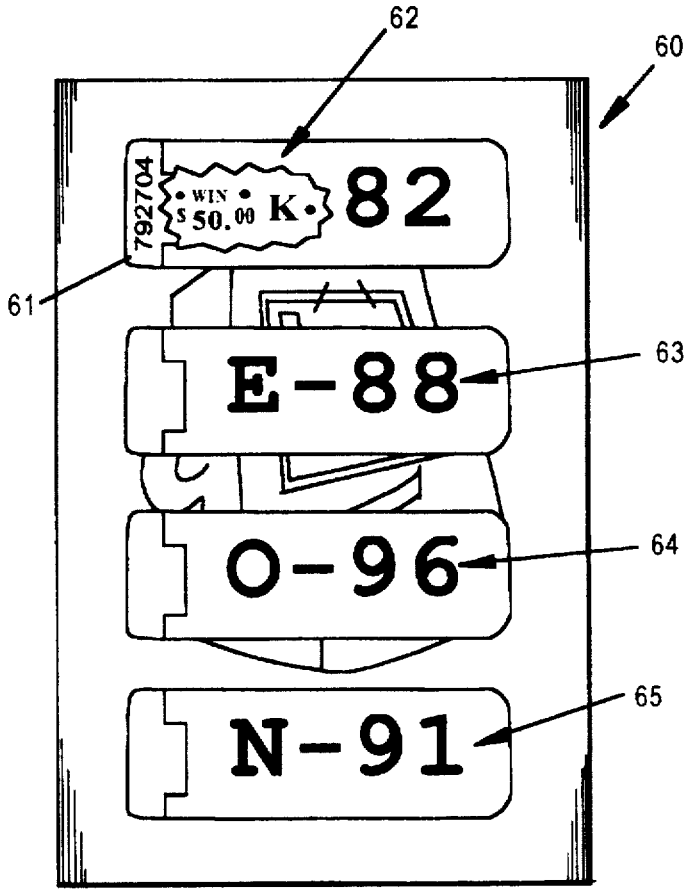
FIG. 4 of the drawings is a top plan view of an opened ticket which is an instant winner.

Comparing the optional instant winner game and the master card game, eligible playing cards 60 for the master card game do not spell "K" "E" "N" "O", as shown in FIG. 5. Only instant winning playing cards 60 spell "K" "E" "N" "O", in any order, as shown in FIG. 4. All instant winning playing cards 60 include an imprint 62 designating the prize based on the corresponding color printed as indicated by the indicia 15 on the tab side 13 of the playing card 60. On instant winner prize amounts of $50 or greater, there is a "secondary winner" protection serialized number 61 printed to the left of the designated dollar winning amount. This six digit number 61 is also printed on the master game card 10 as part of the verification system for "instant winners". Playing cards 60 that are non-winners in the instant winner game and are not playable in conjunction with the master card 10 do not spell "K" "E" "N" "O" and have numerals above 80 and hence off the standard BINGO board, as shown in FIG. 3 by elements 66, 67, 68, and 69. As stated above, instant winning playing cards 60 that do spell "K" "E" "N" "O" have numerics above 80 as shown by elements 63, 64, and 65 of FIG. 4, and are thus not playable with the master card 10. Only playing cards 60 that have numbers 80 or below printed on them, as shown by elements 70, 71, 72 and 73 of FIG. 5, are playable with master card 10.

The numbers 21 printed on the master playing card 10 have been determined by the number portion of the alpha-numeric symbols 65 printed on the playing cards 60. These numbers are randomized by a computer program operating on, for example, an IBM-compatible X86 computer with at least 4MB of RAM operating at 33 MHZ or more. More specifically referring to FIG. 9, a computer logic flow diagram 82 is shown in which all numbers used on N playing cards are inputted into the computer at 83. Then the inputted numbers are divided into N sets based on the location of the numbers on the N playing cards and are located in a random selection pool at 84. More specifically, the sets which are created in the computer are each comprised of four numerals and parallel the four-numeral set of a given playing card. Next, a first of the N sets is randomly selected as the four-number winner, this first set being comprised of numbers $X_1$, $X_2$, $X_3$ and $X_4$ at 85. The four numbers $X_1$, $X_2$, $X_3$ and $X_4$ are next removed at 86 from the random selection pool. The numbers $X_1$, $X_2$, $X_3$ and $X_4$ are placed into a master card pool at 87. The above operation can then be repeated at 88.

In steps indicated at 89, a second of the N sets is randomly selected as the three-number winner, this second set being comprised of numbers $X_5$, $X_6$, $X_7$and $X_8$ . The four numbers $X_5$, $X_6$, $X_7$ and $X_8$ are next removed from the random selection pool. Three of the numbers $X_5$, $X_6$, $X_7$and $X_8$ are randomly selected and then placed into the master card pool. The above operation can then be repeated.

In steps indicated at 90, a third of the N sets is randomly selected as the two-number winner, this third set being comprised of numbers $X_9$, $X_{10}$, $X_{11}$and $X_{12}$. The four numbers $X_9$, $X_{10}$, $X_{11}$and $X_{12}$are next removed from the random selection pool. Two of the numbers $X_9$, $X_{10}$, $X_{11}$and $X_{12}$are randomly selected and then placed into the master card pool. The above operation can then be repeated.

At 91, a fourth of the N sets is randomly selected as the one-number winner, this fourth set being comprised of numbers $X_{13}$, $X_{14}$, $X_{15}$ and $X_{16}$. The four numbers $X_{13}$, $X_{14}$, $X_{15}$ and $X_{16}$are next removed from the random selection pool. One of the numbers $X_{13}$, $X_{14}$, $X_{15}$ and $X_{16}$ are randomly selected and then placed into the master card pool. The above operation is then repeated until done.

The numbers in the master card pool are next randomly organized at 92 for printing onto the master card such that the numbers, as they appear on the master card, are not necessarily listed sequentially as they appear on any single playing card, but preferably appear such that one number from a first playing card is bounded by other numbers from different playing cards.

For security, each master playing card 10 (FIG. 7) is unique to the serial number printed on the playing card 60 and is recorded in the computer file identified by a ten digit number 80 referencing the game and appearing also on the master card 10. Also, the master game card 10 verifies the "sealed award winners" 30, 31, 32, 33, 34 in that it validates each of the playing cards 60 that have matched two or more of the winning numbers printed on the master game card 10 and revalidates the amount of the winnings for these playing cards 60. Instant winners and amounts are also verified at 41, 42, 43, 44 and 45.

An alternative embodiment of the present gaming system shown in FIG. 10 through FIG. 17 has a plurality of playing cards 60' and a master game card 10'. Prime notation of reference numbers in FIGS. 10–17 is used for corresponding elements of the embodiment of FIGS. 1–9.

The first award level is determined by matching three of the numerics called from the master playing card on at least one of the playing cards 60'. The second award level is determined by matching four of the numerics called from the master playing card on at least one of the playing cards 60'. The third award level is determined by matching five of the numerics called from the master playing card on at least one of the playing cards 60'. At least one of the playing cards contains two, or less, of the numerics contained on the master playing card, however, will not receive an award.

Figure 14:
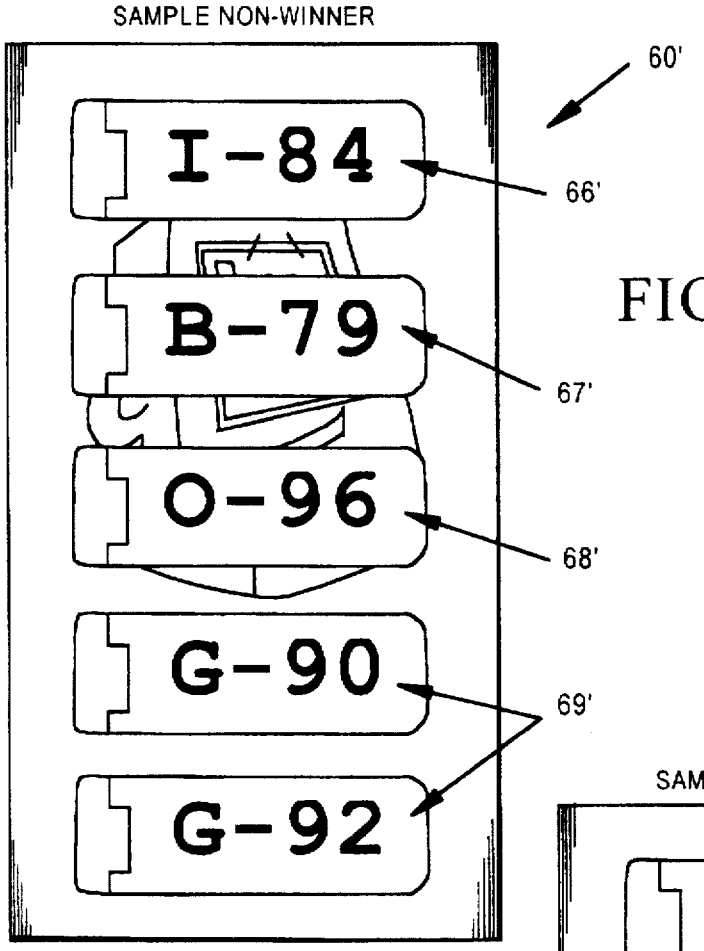
FIG. 14 is a top plan view of a playing card for the game of FIG. 10 with all tabs open and in which there are no winning symbols or no chance for play when the master game card is revealed.
Figure 15:
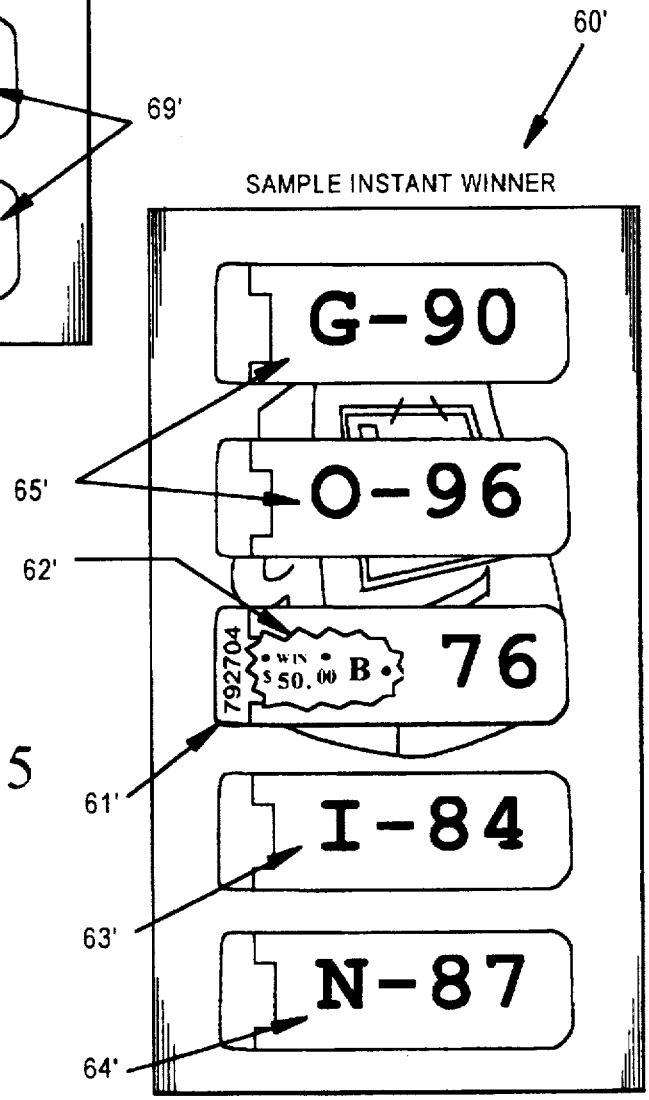
FIG. 15 is a top plan view of an opened card for the game of FIG. 10 which is an instant winner.

Playing card 60' includes a payout side 13' (shown in FIG. 12) and an "open here" or tab side 75' (shown in FIGS. 13 through 17). Tab side 13' of playing card 60' includes a plurality of game symbols 65'. Game symbols may comprise alpha-numeric designations "75" or below, at 70', 71', 72', 73' (FIG. 16), or comprise alpha-numeric designations "81" and above, at 66', 67', 68', 69' (FIG. 14). Alpha designations for this embodiment will always be the letters "B", "I", "N", "G", "O" as at 70', 71', 72', 73' (FIG. 16), and 66', 67', 68', 69' (FIG. 14), and 63', 64', 65' (FIG. 15).

Pay out side 13' of playing card 60' includes indicia 15' indicating a plurality of classes of winning game symbols. Specifically, indicia 15' indicates whether an individual game symbol is within a class of instant winning game symbols, or is within a class of game symbols eligible to be a winning game symbol identified by master game card 10'. In the illustrated embodiment, indicia 15' indicates that game symbols comprising alpha-numeric combination designations equal to "B I N G O" and with numerica above "75" are instant winners. Entitlements are based on color of print being green, gold, blue, gray or red awarding holders of these cards prizes of $1, $2, $3, $5, and $50, respectively. Other prize combinations may be designated. Indicia 15' further indicates that game symbols which comprise alpha-numeric designations with numbers "75" or less are game symbols which are eligible to be winning game symbols identified by master game card 10, potentially entitled to an award up to $250.00. Of course, other and non-monitoring prize designations may be used.

Tab side 75' of playing card 60' (FIG. 13) further includes game symbol concealing means for initially concealing the game symbols 65' displayed upon the playing card. In the illustrated embodiment, the game symbol concealing means comprises a repositionable flap-like member 76'. When the playing cards are initially distributed to players of the present gaming system, all the flap-like members are in a closed position, covering the associated game symbols, as shown for the top most three game symbols (FIG. 13). The players of the present gaming system, i.e., holders of playing cards 60', open each of the flap-like members 76' in order to reveal the game symbols displayed beneath.

In the illustrated embodiment, the playing cards 60' have a 2-ply construction. A first ply bears the game symbols. A second ply, attached to the first ply, includes substantially rectangular regions frangible on three sides, which comprise flap-like members 76' and thus provides the game concealing means.

Figure 10:
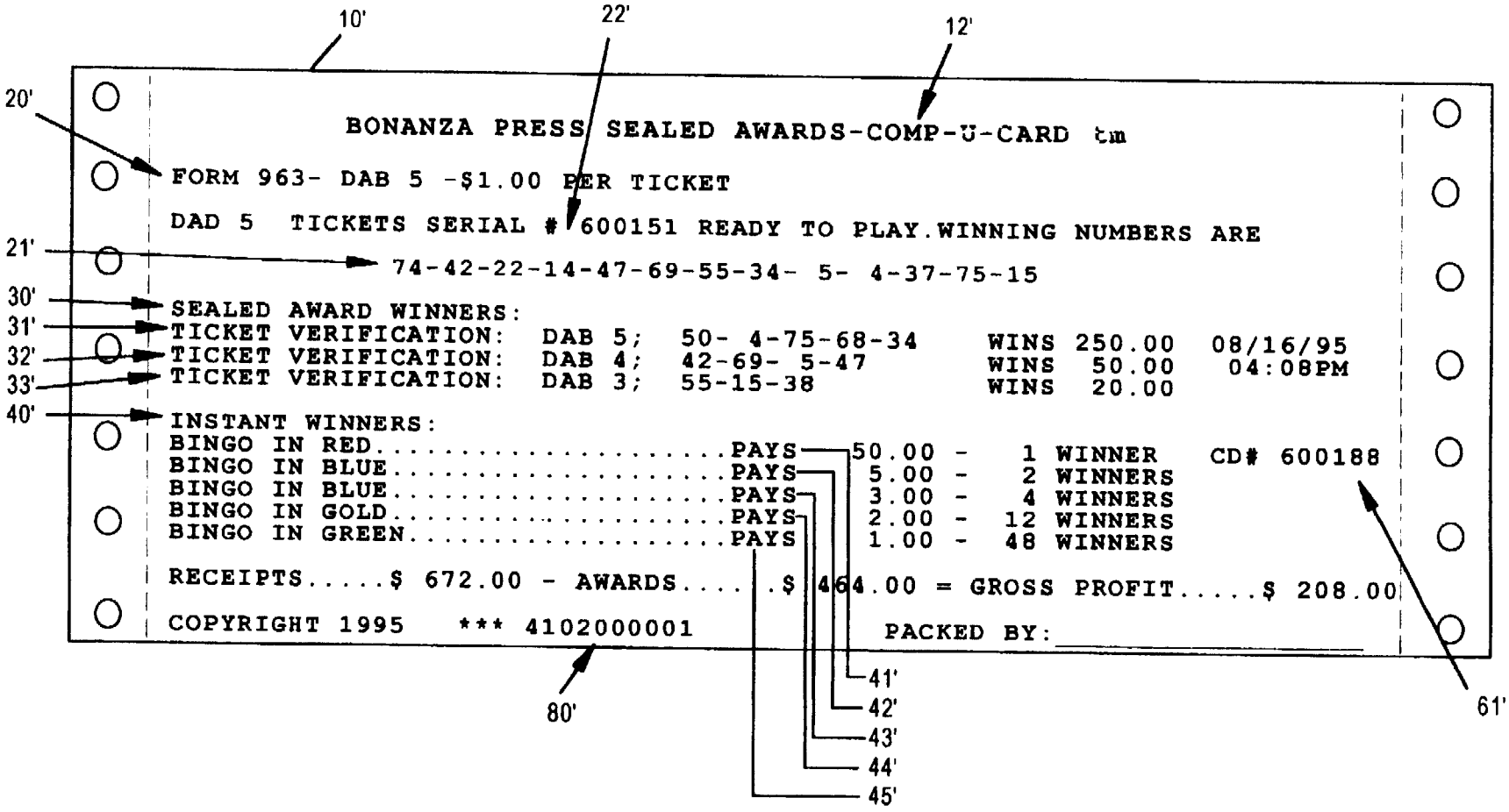
FIG. 10 is a top plan view of the master game card for an alternate embodiment showing, in particular, the plurality of numeral symbols which determines the plurality of winners.
Figure 11:
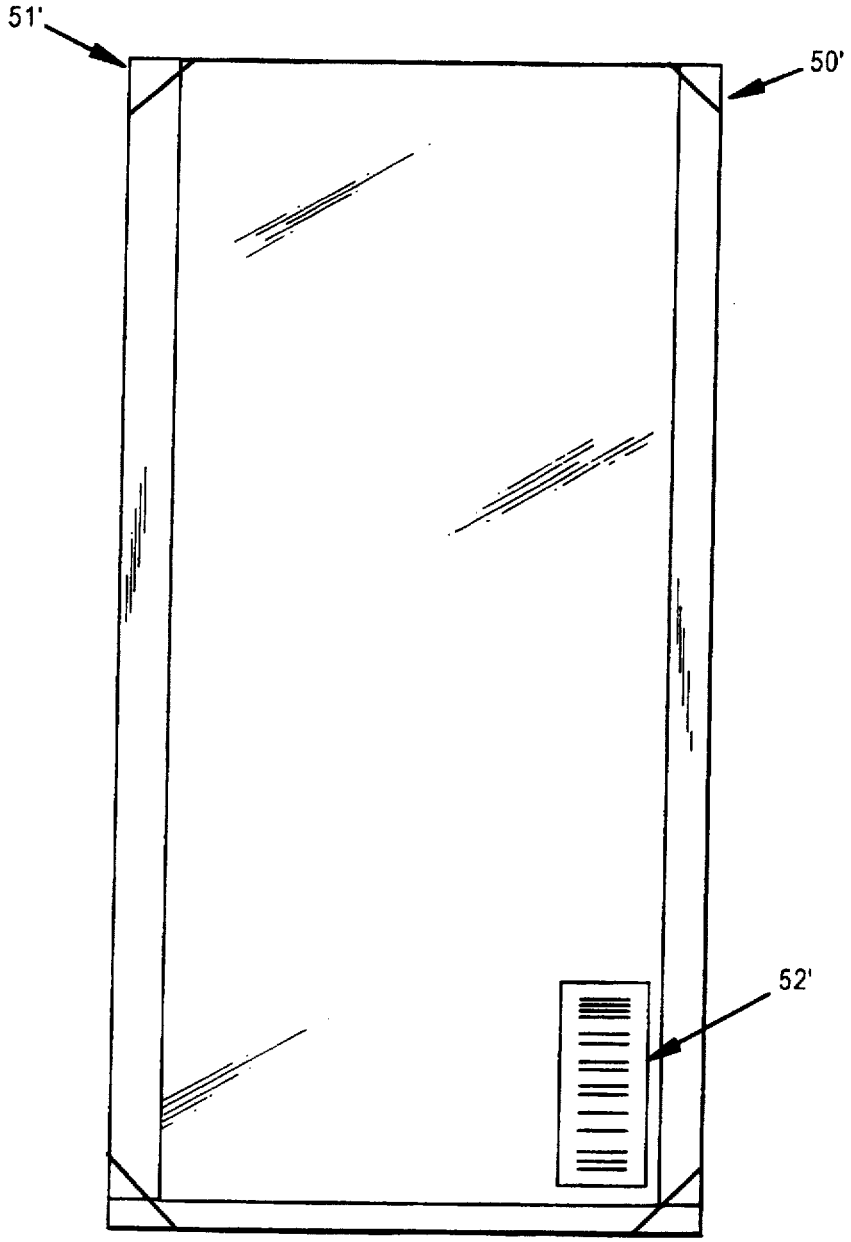
FIG. 11 is a top plan view of the foiled sealed award envelope which conceals the master game card of FIG. 10.

Master game card 10' is shown in FIG. 10 as including a group of fourteen numbers designated "1" through "75". Each ticket or playing card 60' has five flap-like members 76' concealing game symbols 65'. The pay out side 13' of playing card 60' includes an indicia that illustrates awards determined by the numbers concealed on the master game card 10'. Each playing card 60' having numbers "75" or less will always contain five of the numbers eligible to win a prize determined by master game card 10' (see sample playing card 60' of FIG. 16 at references 70', 71', 72', 73'). There may, for example, be one hundred and fifty playing cards, sixty of which are eligible to win during master game card 10' play. Each of the eligible numbers "1" through "75" are designated ten times in the present gaming system.

A holder of a playing card 60' with eligible numbers "1" through "75" (FIG. 16) will match numbers revealed on the master game card 10'. Prizes are determined by how many numbers the holder of the eligible playing card 60' matches of the fourteen numbers printed on the master game card 10'.

There is one playing card 60' that will match a set of three of the numbers printed on the master game card 10'. The holder of this playing card 60' will be awarded a prize as indicated on the indicia 15' on the pay out side 13' of the playing card 60'. This appears as "DAB 3" 17' (FIG. 12).

There is one playing card 60' that will match four of the numbers printed on the master game card 10'. The holder of this playing card 60' will be awarded a prize as indicated on the indicia 15' on the pay out side 13' of the playing card 60'. This is listed as "DAB 4" 18' (FIG. 12).

There is one playing card 60' that will match all of the five numbers printed on the master game card 10'. The holder of this playing card 60' will be awarded a prize as indicated on the indicia 15' on the pay out side 13' of the playing card 60'. This is listed as "DAB 5" 19' (FIG. 12).

There are additional playing cards 60' that will match two or less numbers printed on the master game card 10'. Each of the holders of these playing cards 60' will not be awarded a prize. These playing cards 60' are provided to enhance the present gaming system entertainment value.

Figure 17:
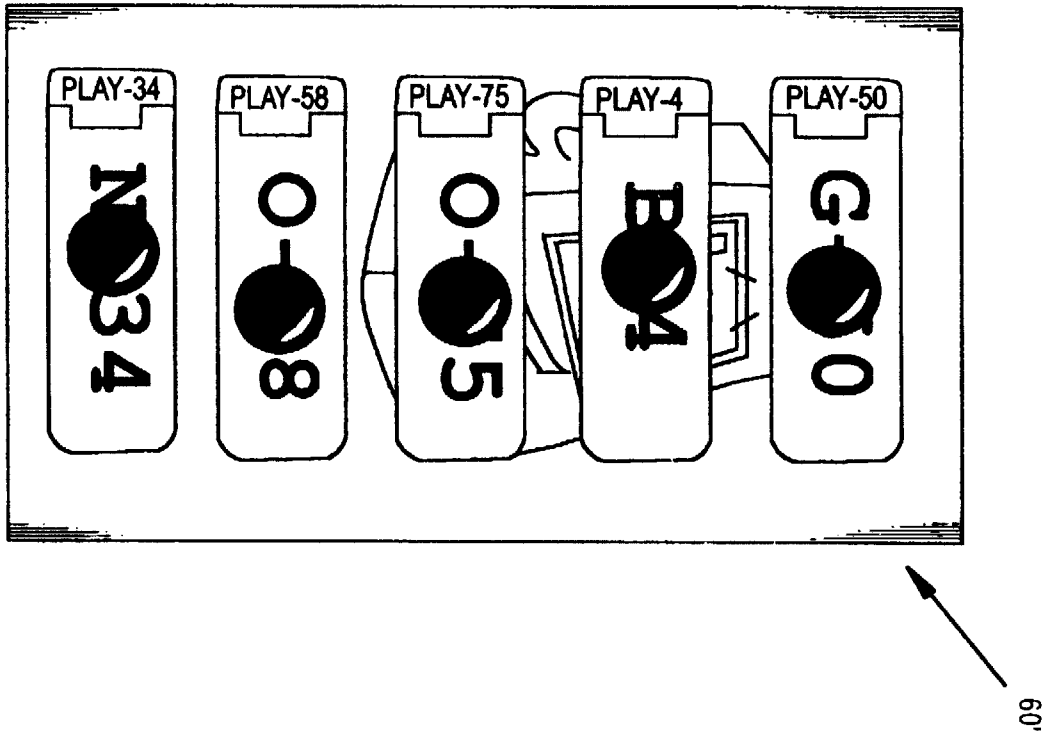
FIG. 17 is a top plan view of a card for the game of FIG. 10 which has been played and stamped during the event of revealing a master game card.

It is recommended that holders of playing cards 60' which are eligible for master game card 10' play mask the numbers that match the numbers printed on the master game card 10' by using a "Bingo Dauber". This is recommended to enhance the present gaming system entertainment value 74' (FIG. 17)

No holder of a playing card 60' eligible to pay for matches with the master game card 10', is "eliminated" until the twelfth number printed is called with only two of the fourteen master number symbols remaining. Then any holder of an eligible playing card 60' with no matched numbers would be eliminated as it takes at least three matches to win.

Figure 16:
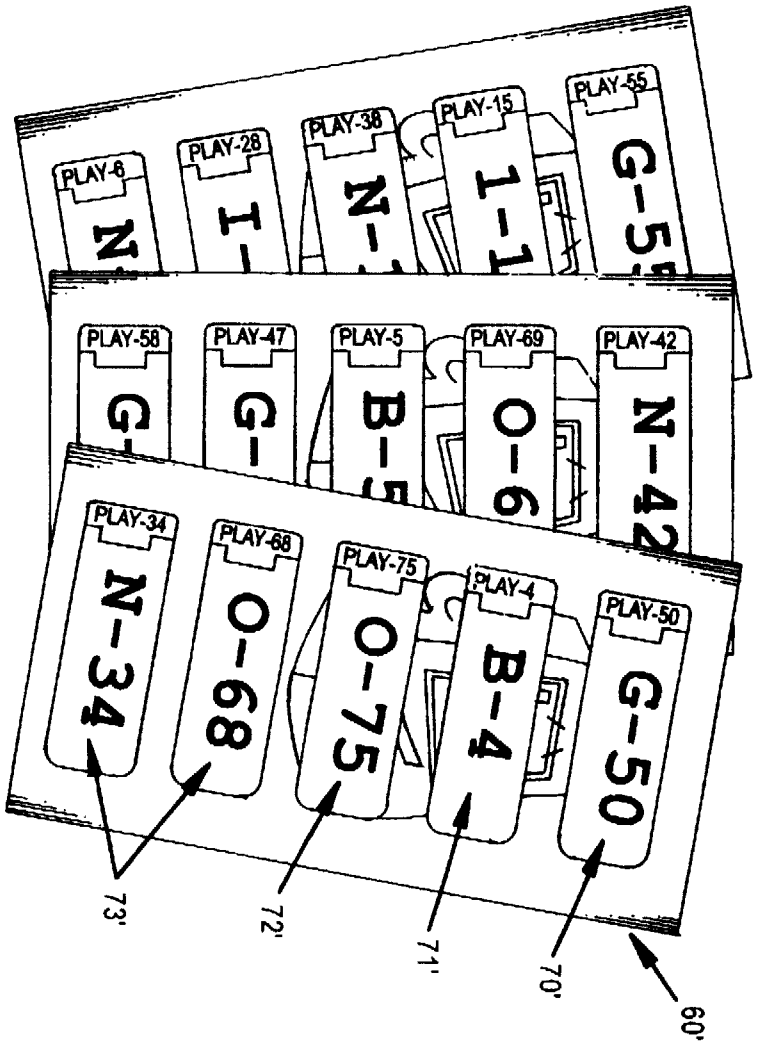
FIG. 16 is a top plan view of sample cards for the game of FIG. 10 which will have a chance to win when the master game card is revealed.

As illustrated in FIG. 16, all eligible playing cards 60'have the word "play" with the present gaming system form number printed in each of the four windows. Also shown in FIG. 16 is the rotation of alpha symbols used on eligible playing cards 60'. Eligible playing cards 60' do not "spell" B I N G O. Only instant winning playing cards (FIG. 15) spell B I N G O in any rotation. All instant winning playing cards 60' include an imprint 62' (FIG. 15) designating the dollar amount of winnings based on the corresponding color printed as indicated by the indicia 15' on the pay out side 13' of the playing card 60'.

On prize amounts of $50 or greater, there is a "secondary winner protection" serialized number printed to the left of the designated dollar winning amount 61' (FIG. 15). This six digit number is also printed on the master game card 10' as part of the verification system for "instant winners" 61'.

Non-winning playing cards 60' that do not spell B I N G O have numerals above "75" (FIG. 5) as indicated at 66', 67', 68', 69'.

Instant winning playing cards 60' that do spell B I N G O have numerics above 80 (FIG. 15) 63', 64', 65'.

Only playings cards 60' that are eligible for awards determined by the master game card 10' have numbers 80 or below printed on them (FIG. 16) 70', 71', 72', 73'.

The master game card 10' (FIG. 10) is enclosed in a sealed opaque lined foiled envelope 50' (FIG. 11) that has a bar code label 52' affixed to it with the same serial number on it that is printed on all of the playing cards 60' in the present gaming system. The master game 10' card is kept sealed until all of the playing cards 60' have been purchased.

The master game card 10' has a purple highlighted section which, when removed from the envelope 50', is read. It announces at 20' the name of the game, the serial number 22' of playing cards 60', and the winning numbers at line 21'.

The numbers printed on the master playing card 10' have been determined by the numbers printed in combination on the playing cards 60', then randomized by a computer program which is interfaced with the manufacturing system of the playing cards 60'. This system uniquely provides a maximum variation of combinations of winning numbers and therefore enhances the entertainment of the present gaming system. This has been marked at 12' as "COMPU-U-CARD™ SEALED AWARDS".

Each master playing card 10' is unique to the serial number printed on the playing card 60' and is recorded in the computer file identified by a 10 digit number referencing the game (FIG. 1) 80'.

The master game card 10' verifies the "sealed award winners" 30' at 31', 32', and 33' in that it validates each of the playing cards 60' that have matched three or more of the winning numbers printed on the master game card 60' and it revalidates the amount of the winnings for those playing cards 60'. The master game card 10' also validates the instant winners and amounts at 40', 41', 42', 43', 44', and 45'.

Figure 18:
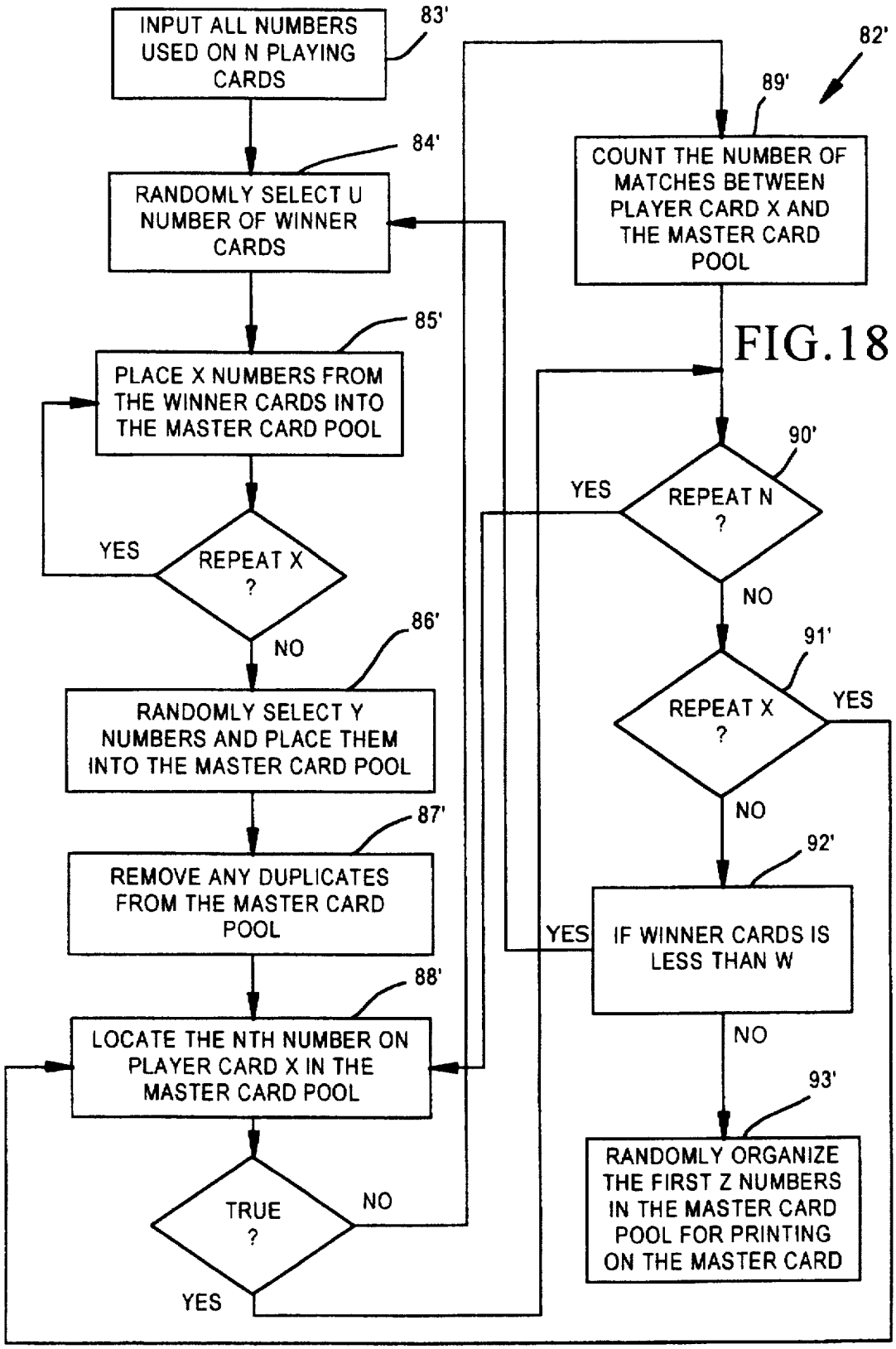
FIG. 18 is a flow chart of the computer program for selecting and assigning winning symbols (numbers) for the cards of the game in FIGS. 10–17.

A computer program represented in the flow diagram 82' of FIG. 18 is used to randomize the card symbols, such as the numbers 1–75. All numbers or symbols N are input into the computer at 83'. At 84', the computer randomly selects U number of winning cards depending upon the desired total payout. X numbers from the winning cards are placed in a master card pool at 85' and repeated until done. Then a random selection of Y numbers is placed in the master card pool at 86', duplicates are removed at 87'.

In a routine beginning with 88', the computer locates the nth number on playing card X in the master card pool and, when true, counts at 89' the number of matches between player card X and the master card pool, repeating this routine by the loop back operations at repeat n decision 90' and repeat X decision at 91'. When no further repeats are required, the computer determines if the winner cards are less than W and, if so, loops back to block 84' to continue processing for numbers. When the number of winner cards is equal to W, the resulting number are organized according to block 93' by randomly organizing the first Z numbers in the master card pool for printing on the master card.

While particular embodiments of the present invention have been described in some detail herein above, changes and modifications may be made in the illustrated embodiments without departing from the spirit of the invention.

I claim:

1. A gaming method to be played with a plurality of playing cards comprising:

selecting by a computer process a plurality of playing card game symbols and placing at least two game symbols on each playing card such that each playing card has the same total number of game symbols;

randomly selecting with a computer process a plurality of sets of winning game symbols from the plurality of selected playing card game symbols, with at least some sets of winning game symbols having a different number of game symbols than other sets of winning game symbols, with each set of winning game symbols being a unique set of game symbols compared to all other sets of winning game symbols, and causing each set of winning game symbols to appear on only one playing card; and using a computer for randomly organizing and listing in random order all of the game symbols for all of the sets of winning game symbols onto a master card such that all of the game symbols for any one set of winning game symbols are not listed sequentially on said master card.

2. The method of claim 1 wherein four game symbols are selected for placement on each playing card, three sets of winning game symbols are randomly selected and the number of winning game symbols in the three sets are two, three and four.

3. The method of claim 1 wherein non-winning game symbols are randomly organized with the randomly organized game symbols for all of the sets of winning game symbols to be listed on a master card.

4. The method of claim 1 wherein the number of sets of winning game symbols is equal to the number of game symbols on each playing card.

5. The method of claim 1 wherein five game symbols are selected for each playing card, three sets of winning game symbols are randomly selected and the number of winning game symbols in the three sets are three, four and five.

6. A gaming method for play with a plurality of playing cards and a master card, comprising:

selecting a plurality of playing card game symbols and placing at least two game symbols on each playing card such that each playing card has the same total number of game symbols;

randomly selecting by a computer a plurality of sets of winning game symbols from the plurality of selected playing card game symbols where the number of sets of winning game symbols is equal to the number of game symbols on each playing card, with at least some sets of winning game symbols having a unique number of game symbols with respect to other sets of winning game symbols, with each set of winning game symbols being a different set of game symbols than all other sets of winning game symbols, and causing each set of winning game symbols to appear on only one playing card; and randomly organizing by a computer and listing in random order all of the game symbols for all of the sets of winning game symbols onto a master card such that all of the game symbols for any one set of winning game symbols are not listed sequentially on said master card.

7. The method of claim 6 wherein four game symbols are selected for each playing card, three sets of winning game symbols are randomly selected and the number of winning game symbols in the three sets are two, three and four.

8. The method of claim 6 wherein non-winning game symbols are randomly organized with the randomly organized game symbols for all of the sets of winning game symbols to be listed on a master card.

9. The method of claim 6 wherein five game symbols are selected for each playing card, three sets of winning game symbols are randomly selected and the number of winning game symbols for the three sets are three, four and five.

10. A gaming method for playing with a plurality of cards including playing cards and a master card, comprising:

selecting a plurality of playing card game symbols and placing at least two game symbols on each playing card such that each playing card has the same total number of game symbols;

randomly selecting in a computer a plurality of sets of winning game symbols from the plurality of selected playing card game symbols, with at least some sets of winning game symbols having a different number of game symbols than other sets of winning game symbols, with each set of winning game symbols being a unique set of game symbols compared to all other sets of winning game symbols, and causing each set of winning game symbols to appear on only one playing card;

randomly organizing in a computer all of the game symbols for all of the sets of winning game symbols and listing them on a master card such that all of the game symbols for any one set of winning game symbols are not listed sequentially; and randomly organizing in a computer non-winning game symbols with the randomly organized game symbols for all of the sets of winning game symbols and listing them on a master card.

11. The method of claim 10 wherein four game symbols are selected for each playing card, three sets of winning game symbols are randomly selected and the number of winning game symbols in the three sets are two, three and four.

12. The method of claim 10 wherein the number of sets of winning game symbols is equal to the number of game symbols on each playing card.

13. The method of claim 10 wherein five game symbols are selected for each playing card, three sets of winning game symbols are randomly selected and the number of winning game symbols in the three sets are three, four and five.

* * * * *